US006265714B1

(12) United States Patent
Shimomura

(10) Patent No.: US 6,265,714 B1
(45) Date of Patent: Jul. 24, 2001

(54) MASS SPECTROMETER AND METHOD OF MONITORING DEGRADATION OF ITS DETECTOR

(75) Inventor: Manabu Shimomura, Kyoto (JP)

(73) Assignee: Shimadzu Corporation (JP)

( * ) Notice: Subject to any disclaimer, the term of this patent is extended or adjusted under 35 U.S.C. 154(b) by 0 days.

(21) Appl. No.: 09/361,798

(22) Filed: Jul. 27, 1999

(30) Foreign Application Priority Data

Aug. 4, 1998 (JP) ..... 10-219965

(51) Int. Cl.[7] ..... H01J 49/00

(52) U.S. Cl. ..... 250/281; 250/282; 250/283; 250/397

(58) Field of Search ..... 250/281, 282, 250/283, 284, 286, 300, 397

(56) References Cited

U.S. PATENT DOCUMENTS 5,247,175 * 9/1993 Schoen et al. ..... 250/281

* cited by examiner

*Primary Examiner*—Kiet T. Nguyen
(74) *Attorney, Agent, or Firm*—Coudert Brothers

(57) ABSTRACT

A mass spectrometer generates an ion current, accelerates it and passes it through a mass filter to be received by a detector which outputs a signal according to the intensity of this ion current. A control unit serves not only to carry out mass spectrometry experiments on a specified reference sample under specified conditions but also to judge the level of degradation of the detector from both the intensity values of output signals from the detector during each of these experiments and the standard deviation of these measured intensity values.

10 Claims, 1 Drawing Sheet

MASS SPECTROMETER AND METHOD OF MONITORING DEGRADATION OF ITS DETECTOR

BACKGROUND OF THE INVENTION

This invention relates to a mass spectrometer and more particularly to a mass spectrometer provided with means for monitoring the level of degradation of its detector. The invention also relates to a method of monitoring the level of degradation of the detector of such a mass spectrometer.

In a mass spectrometer, a sample to be analyzed is initially ionized in an ionization chamber (herein referred to as the "ion source"). Ions of different kinds are normally generated in the ion source and are then accelerated by an ion lens to enter a mass filter comprising, for example, a quadrupole such that only the ions having a specified mass-to-charge ratio are allowed to pass through the filter and are detected by a detector.

Secondary electron multiplier tubes are the most commonly used type of detectors used with a mass spectrometer. A secondary electron multiplier tube is a detector adapted to output an electric signal with intensity according to the number of incident electrons by making use of a metal which emits a larger number of secondary electrons than the number of incident ions thereon with energy greater than a specified value. In general, members which are made of such a metal are arranged in a plurality of stages such that the number of secondary electrons will increase in a step-wise fashion and those secondary electrons emitted from the metal member of the last stage are taken out as the electric signal. A specified voltage difference is applied between each mutually adjacent pair of metal members when ions are being detected but the ion-electron multiplication factor (the ratio between the number of emitted electrons and that of the incident ions) will naturally change if this voltage is varied.

These metal members become degraded due to pollution by ions whenever a sample analysis is carried out, and this affects the ion-electron multiplication factor. One of the prior art methods for checking the level of degradation of a secondary electron multiplication tube has been to introduce a specified amount of a reference sample is introduced into the mass spectrometer while the applied voltage (to the metal members) is set at a specified level and to detect the ions generated from this reference sample as described above. By comparing the detected intensity of the output signal from the secondary electron multiplier tube with its initial value when the tube was still new, one can determine the condition of the degradation.

This method of judging the condition of degradation is not truly trustworthy. For example, although the condition of degradation is the same, the detected intensity of the output signal from the secondary electron multiplication tube will be lower if a different component of the mass spectrometer such as its ion source is degraded because this will be adversely affecting the efficiency of generating ions. In other words, one cannot determine with a method as described above if a drop in the intensity of the output signal is due to the degradation of the secondary electron multiplier tube itself or that of some other component. As a result, one may end up carrying out a wasteful maintenance work although the cause of the drop in the signal intensity is elsewhere by mistakenly believing that the cause was in the detector.

SUMMARY OF THE INVENTION

It is therefore an object of this invention in view of the problem as described above to provide a mass spectrometer having means for monitoring the condition or the level of degradation of its detector comprising a secondary electron multiplier tube.

It is another object of this invention to provide a method of monitoring the level of degradation of a detector such as a secondary electron multiplier of a mass spectrometer.

A mass spectrometer embodying this invention, with which the above and other objects can be accomplished, may be characterized, not only as generating an ion current, accelerating it and passing it through a mass filter into a detector adapted to output a signal according to the intensity of this ion current, but also as comprising a control unit which serves to carry out mass spectrometry experiments on a specified reference sample under specified conditions and to judge the level of degradation of the detector from both the intensity values (for example, the numbers of ions detected per unit time by the detector) of output signals from the detector during each of these experiments and the standard deviation of these measured intensity values.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 2:
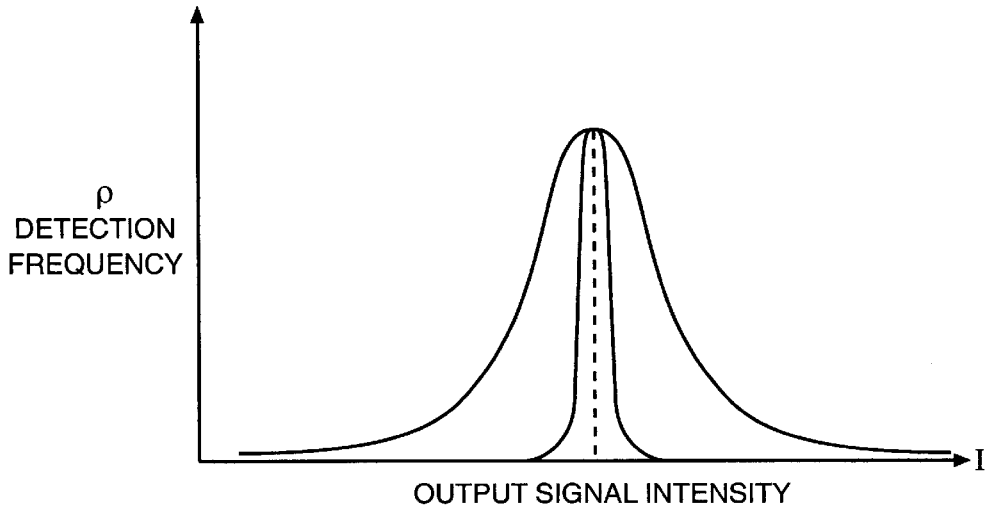
FIG. 2 is a graph for showing the relationship between output signal intensity and detection frequency.

While an ion current of a constant intensity is being received by a detector, its detector will serve to output a signal depending upon this intensity of the ion current but the intensity of this output signal is not completely constant but includes some fluctuations. If the output signal of the detector is sampled many times while it is receiving an ion current of a constant intensity, the distribution curve, representing the relationship between the intensity of output signal (I) and the frequency of signal detection at each intensity level ($\rho$) will be as shown in FIG. 2, peaking at a certain central intensity value. It is to be reminded, however, that the curve in FIG. 2 is drawn in a schematic fashion with its spread drawn in an exaggerated fashion for the convenience of description.

Let us now consider a situation where the multiplication factor of the detector has dropped because of the degradation of the detector itself. In such a situation, the fluctuation in the intensity of the output signal will drop also at the same rate as the drop in the intensity of the output signal. Thus, the ratio between the fluctuation and the intensity will hardly change in spite of any change in the multiplication factor. If the drop in the intensity of the output signal is due to some other cause such as the drop in the intensity of the ion current occasioned by the degradation of the ion source, by contrast, the fluctuation in the output signal will drop at a rate which is different from that of the drop in the intensity, the fluctuation generally dropping at a slower rate than the intensity of the output signal. In summary, the ratio between the fluctuation and the intensity of the output signal will change if the output signal drops by some other cause. The present invention is based on this observation.

Figure 1:
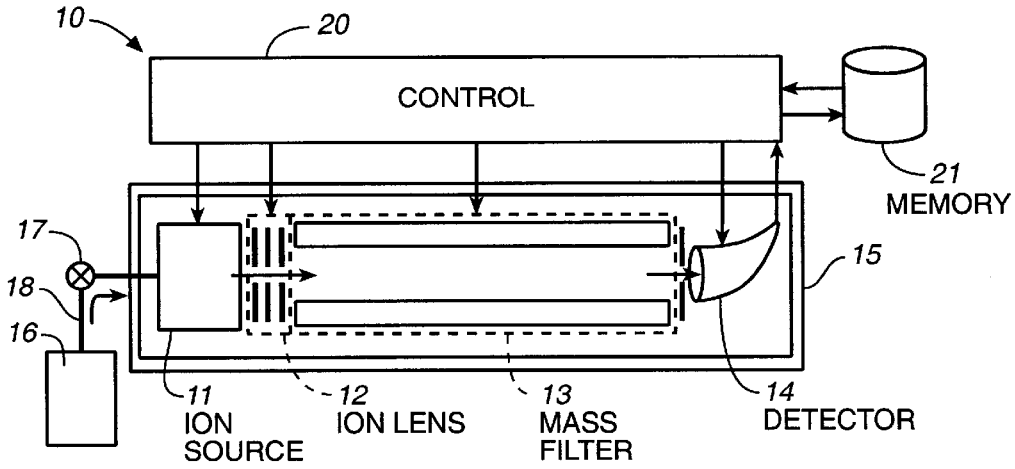
FIG. 1 is a schematic block diagram of a mass spectrometer embodying this invention.

The invention is described next by way of an example with reference to FIG. 1 which shows a mass spectrometer 10 of this invention as having an ion source 11, an ion lens 12, a mass filter (a quadrupole) 13 and a secondary electron multiplier tube serving as a detector 14 enclosed inside a vacuum container 15. A device 16 for introducing a reference sample is disposed outside this vacuum container 15 and is connected to the ion source 11 through a tube 18 with a valve 17 therein. The ion source 11, the ion lens 12, the quadrupole 13 and the detector 14 are all connected to a control unit 20 to which is also connected a memory device (such as a hard disc drive) 21. The control unit 20 and the memory device 21 may be formed by installing a specified program and a device driver in a commonly used personal computer. Preliminarily set in the memory device 21 are condition setting data on the conditions of measurement for the purpose of adjustment, such as the ionization voltage for the ion source 11, the accelerating voltage for the ion lens 12, the voltage to be applied to the detector 14 and the direct-current voltage to be applied to the quadrupole 13, a high-frequency voltage and its frequency. In the example being described here, the direct-current voltage to be applied to the quadrupole 13, the high-frequency voltage and its frequency are preliminarily set such that only ions with a specified mass-to-charge ratio can pass through the quadrupole 13.

The level of degradation of the detector 14 is checked as follows. First, the user places a reference sample inside the aforementioned reference sample introducing device 16 and operates an input device (not shown) such as the keyboard of a personal computer to transmit to the control unit 20 a command to start the adjustment. Upon receiving this command, the control unit 20 reads out the aforementioned adjustment data stored in the memory device 21 and controls the operations of the ion source 11, the ion lens 12, the quadrupole 13 and the detector 14 on the basis of these data. If the valve 17 is opened thereafter, the reference sample inside the device 16 begins to flow through the tube 18 into the ion source 11. After a time period which is sufficiently long for stabilizing the flow rate of the reference sample into the ion source 11, the control unit 20 samples the output signal continuously for a specified number of times. If each sampling time is 100 $\mu$s and the specified number of times is 100, the control unit 20 will be required to monitor the output signals from the detector 14 for a period of 10 seconds, measuring the intensity of the output signal from the detector 14 at the rate of once every sampling time. The intensity data thus obtained are sequentially stored either in another storing means not shown in FIG. 1 or the memory device 21 shown in FIG. 1.

After the specified number of sampling has been completed, the control unit 20 reads out the stored intensity data and obtains therefrom the average intensity and the standard deviation, as well as their ratio (hereinafter referred to as the "deviation-to-average ratio"). These numerical data are also stored in the memory device 21 so as to serve as the data for determining the detector degradation. Collection of such data for determination of detector degradation is preferably carried at a specified frequency such as once for every analysis, once every day or once per week.

When the mass spectrometer 10 is adjusted for the second time, or at the time of any subsequent adjustment, the data from the previous adjustment are already stored in the memory device 21. Thus, the control unit 20 can retrieve data stored earlier and to thereby determine the current level of degradation of the detector 14 by comparing the current data with such earlier data.

The method of determining the level of detector degradation is explained next by way of examples with reference to Tables 1 and 2 which show results of data obtained as described above from two mass spectrometers A and B, respectively, each adjusted in four experiments. Table 1 for mass spectrometer A shows that the average intensity of the detector decreases with time but hardly any change is observed in the deviation-to-average ratio. Thus, it may be concluded that the lowering in the intensity of the output signals from the detector of mass spectrometer A is due to the degradation of the detector itself. Table 2 shows, on the other hand, that the deviation-to-average ratio increases as the average intensity drops. This indicates that the lowering of the intensity of the output signals is due not only to the degradation of the detector itself but also to some other factors.

TABLE 1

| Adjustment | Average Intensity | Standard Deviation | Deviation-to-Intensity Ratio |
|---|---|---|---|
| First | 800,000 | 800 | 0.001 |
| Second | 700,000 | 700 | 0.001 |
| Third | 400,000 | 420 | 0.00105 |
| Fourth | 100,000 | 110 | 0.0011 |

TABLE 2

| Adjustment | Average Intensity | Standard Devaition | Deviation-to-Intensity Ratio |
|---|---|---|---|
| First | 800,000 | 800 | 0.001 |
| Second | 700,000 | 800 | 0.00114 |
| Third | 400,000 | 800 | 0.002 |
| Fourth | 100,000 | 400 | 0.004 |

The example described above is not intended to limit the scope of the invention. Many modifications and variations are available within the scope of this invention. For example, a standard value of the deviation-to-intensity ratio may be preliminarily specified in order to automatically identify an abnormal change in the ratio. A display device such as a display screen of a personal computer may be used in such an application, although not shown in FIG. 1, such that the control unit 20 may serve to cause a warning message displayed thereupon when the calculated ratio exceeds the preliminarily specified reference ratio value. In the example of Tables 1 and 2, if the reference ratio value is set to 0.002, mass spectrometer B will be outputting such a warning message at the fourth adjustment.

What is claimed is:

1. A mass spectrometer comprising:

a detector serving to receive an input signal indicative of an ion current and to output an output signal obtained by amplifying said input signal;

testing means for carrying out mass spectrometry experiments on a specified reference sample under specified conditions; and judging means for judging level of degradation of said detector from intensity values of output signals from said detector during each of said mass spectrometry experiments by said testing means on said reference sample and standard deviation of said intensity values.

2. The mass spectrometer of claim 1 further comprising:

an ion source where ions are generated;

an ion lens for accelerating ions generated in said ion source; and a mass filter means for allowing only those of ions having a specified mass-to-charge ratio to be received by said detector.

3. The mass spectrometer of claim 1 wherein said testing means and said judging means are parts of a control unit which also serves to calculate an average of said intensity values, said standard deviation and a ratio between said standard deviation and said average, said judging means judging said level of degradation from changes in said ratio as said average changes from one to another of said mass spectrometry experiments.

4. The mass spectrometer of claim 3 further comprising a memory means storing a preliminarily specified reference ratio value, said control unit further serving to cause a warning to be outputted if said radio exceeds said preliminarily specified reference ratio value stored in said memory means.

5. A method of monitoring level of degradation of a detector of a mass spectrometer, said method comprising the steps of:

carrying out mass spectrometry experiments on a specified reference sample with said mass spectrometer under specified conditions and obtaining output signals from said detector;

judging level of degradation of said detector from intensity values of said output signals from said detector during each of said mass spectrometry experiments with said mass spectrometer on said reference sample and standard deviation of said intensity values.

6. The method of claim 5 further comprising the steps, during each of said mass spectrometry experiments, of:

generating ions from said reference sample;

accelerating said ions generated from said reference sample; and filtering and thereby allowing only those of the accelerated ions having a specified mass-to-charge ratio to be received by said detector.

7. The method of claim 5 further comprising the step of calculating an average of said intensity values, said standard deviation and a ratio between said standard deviation and said average during each of said mass spectrometry experiments.

8. The method of claim 7 wherein said level of degradation of said detector is judged from changes in said ratio as said average changes from one to another of said mass spectrometry experiments.

9. The method of claim 7 further comprising the steps of:

preliminarily specifying a reference ratio value; and outputting a warning according to a result of comparison between said ratio and said reference ratio value.

10. The method of claim 9 further comprising the step of storing said reference ratio value.

* * * * *